US010202981B2

(12) United States Patent
Lin et al.

(10) Patent No.: US 10,202,981 B2
(45) Date of Patent: Feb. 12, 2019

(54) MODULAR FAN BLADE

(71) Applicant: COOLER MASTER CO., LTD., New Taipei (TW)

(72) Inventors: Fu-Lung Lin, New Taipei (TW); Tsung-Wei Lin, New Taipei (TW); Chun-Hsien Chen, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 540 days.

(21) Appl. No.: 14/819,143

(22) Filed: Aug. 5, 2015

(65) Prior Publication Data

US 2017/0002833 A1 Jan. 5, 2017

(30) Foreign Application Priority Data

Jul. 3, 2015 (TW) ..... 104210750 U

(51) Int. Cl.

| | |
|---|---|
| ***F04D 29/38*** | (2006.01) |
| ***F04D 29/28*** | (2006.01) |
| ***F04D 29/32*** | (2006.01) |
| ***F04D 17/02*** | (2006.01) |
| ***F04D 17/16*** | (2006.01) |
| ***F04D 19/00*** | (2006.01) |

(52) U.S. Cl.

CPC ..... *F04D 29/384* (2013.01); *F04D 17/025* (2013.01); *F04D 17/16* (2013.01); *F04D 19/002* (2013.01); *F04D 29/281* (2013.01); *F04D 29/329* (2013.01)

(58) Field of Classification Search

CPC ..... F04D 29/384; F04D 29/38; F04D 29/281; F04D 29/329; F04D 17/025; F04D 17/16

See application file for complete search history.

(56) References Cited

U.S. PATENT DOCUMENTS

| | | | | |
|---|---|---|---|---|
| 6,318,964 | B1 * | 11/2001 | Yang | B29C 45/006 415/198.1 |
| 6,572,336 | B2 * | 6/2003 | Horng | F04D 29/023 416/183 |
| 6,779,992 | B2 * | 8/2004 | Lei | F04D 29/023 416/198 R |
| 7,182,572 | B2 * | 2/2007 | Yang | F04D 29/325 415/175 |
| 2005/0249598 | A1 * | 11/2005 | Young | F04D 25/088 416/198 R |
| 2012/0219437 | A1 * | 8/2012 | Nakamura | A47L 5/22 417/423.1 |
| 2013/0259667 | A1 * | 10/2013 | Huang | F04D 19/002 415/185 |

* cited by examiner

*Primary Examiner* — Richard A Edgar
*Assistant Examiner* — Michael L Sehn
(74) *Attorney, Agent, or Firm* — Maschoff Brennan

(57) ABSTRACT

A modular fan blade includes a first fan blade and a second fan blade. The first fan blade includes a hub and plural first vanes, and the hub has an external periphery, and the first vane is combined with the external periphery, and a flange is formed at the external periphery and a retaining space is formed on a surface of the flange; and the second fan blade includes a fan frame and plural second vanes, and the fan frame is installed at the flange of the hub, sheathed on the hub, and installed in the retaining space, so as to achieve the effects of increasing the wind output of the fan effectively and replacing the blades conveniently.

8 Claims, 6 Drawing Sheets

MODULAR FAN BLADE

FIELD OF THE INVENTION

The technical field relates to fans, more particularly to a modular fan blade of fans.

BACKGROUND OF THE INVENTION

As 3C (Computer, Communication and Consumer electronic) products advance rapidly, the processing or computing speed of these 3C products becomes increasingly great. In the meantime, the temperature of the heat generated during the operation of various types of electronic components also increase continuously. To prevent electronic components of these products from being damaged by the high heat, most of the present electronic components come with a cooling device for dissipating the high heat generated during the operation of the electronic components.

Fans are common cooling devices used to overcome the heat dissipating problem. As the operating temperature of the electronic components increases continuously, the rotating speed and the wind output of the fan must be increased accordingly to achieve the required heat dissipating effect. However, if the rotating speed of the fan increases, the noise produced by the rotation of the fan will increase as well. Further, the rotating speed of the fan has an upper limit, and a too-high rotating speed will cause a reduced wind pressure of the fan which will affect the wind output of the fan. Therefore, it is a subject for related manufacturers to increase the wind output at a specific wind pressure in order to enhance the heat dissipating efficiency.

In view of the aforementioned problem of the prior art, the inventor of this disclosure based on years of experience in the industry conducted extensive research and experiments to finally provide a feasible solution to overcome the problem of the prior art effectively.

SUMMARY OF THE INVENTION

It is a primary objective of this disclosure to provide a modular fan blade capable of increasing the wind output of a fan and replacing the vanes conveniently if needed.

To achieve the aforementioned objective, this disclosure provides a modular fan blade, comprising a first fan blade and a second fan blade. The first fan blade includes a hub and a plurality of first vanes, and the hub has an external periphery, and the first vane is combined with the external periphery, and a flange is formed at the external periphery, and a retaining space is formed on a surface of the flange; and the second fan blade includes a fan frame and a plurality of second vanes, and the fan frame is disposed at the flange of the hub, sheathed on the hub, and installed in the retaining space.

Another objective of this disclosure is to provide a modular fan blade having a plurality of second vanes partially disposed on the first vanes in order to reduce the total volume of the modular fan blade.

A further objective of this disclosure is to provide a modular fan blade having a second fan blade that may be combined with the first fan blade through a latching or screwing method to enhance the flexibility of use.

Compared with the prior art, the modular fan blade of this disclosure comprises a first fan blade and a second fan blade, and the first fan blade has a flange formed at the external periphery of the hub, so that the fan frame of the second fan blade may be installed to the flange and sheathed on the hub, and the second fan blade may be combined with the first fan blade by a combining method to form the modular fan blade and improve the effect of increasing the wind output of the fan. In addition, the first fan blade and second fan blade of this disclosure include but are not limited to the axial flow fan blade or the centrifugal fan blade, but they can be changed according to actual requirements, so as to improve the convenience and practicality of the use.

DESCRIPTION OF THE PREFERRED EMBODIMENTS

Figure 1:
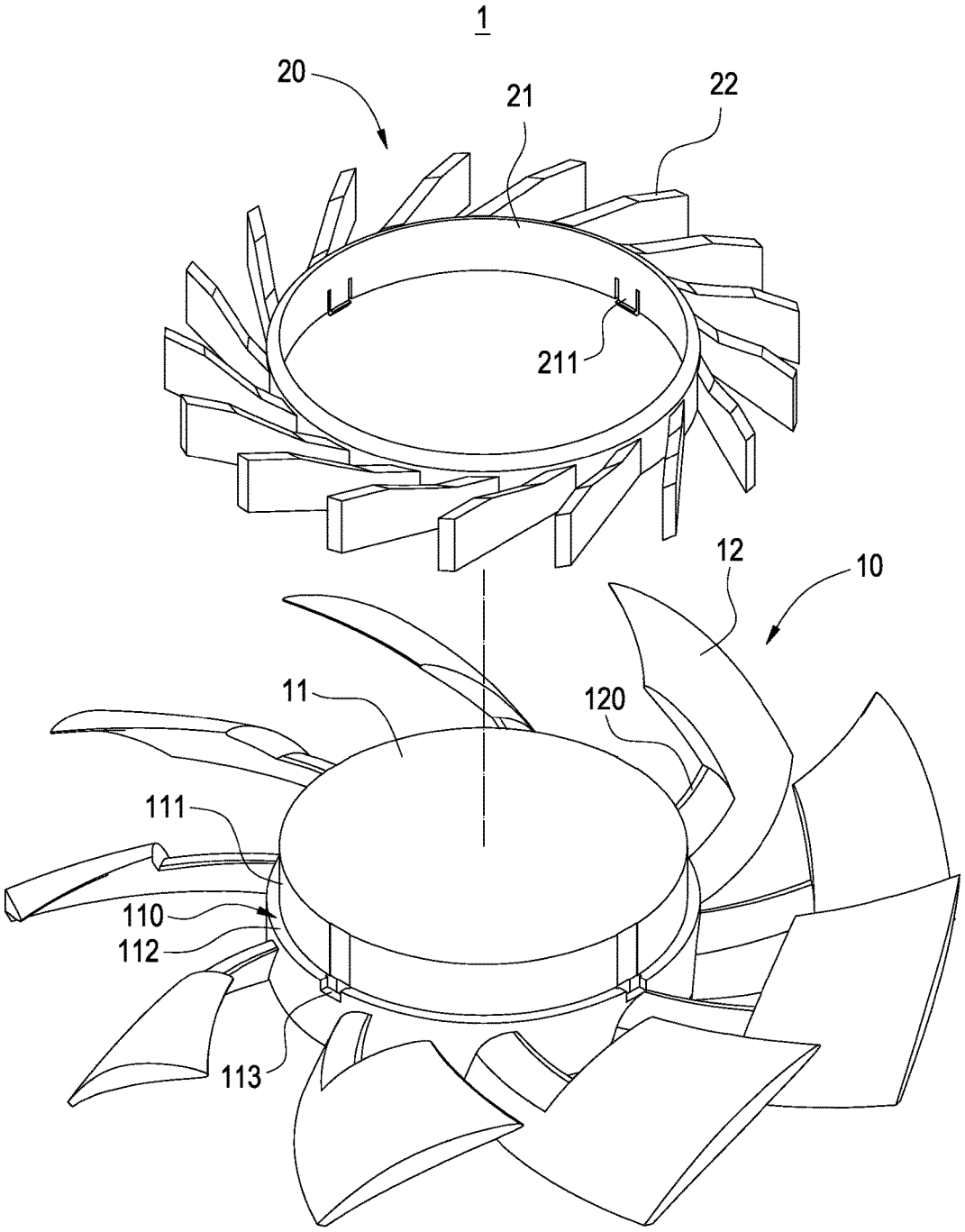
FIG. 1 is an exploded view of a modular fan blade of this disclosure.
Figure 2:
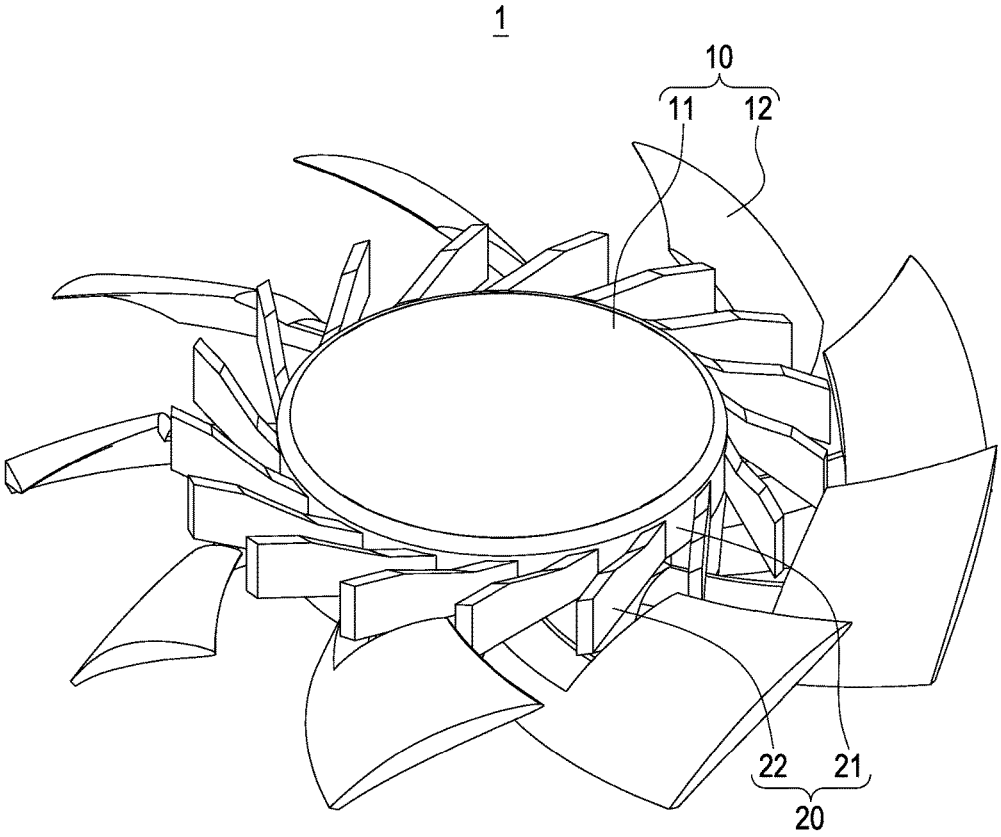
FIG. 2 is a perspective view of a modular fan blade of this disclosure.

The technical contents of this disclosure will become apparent with the detailed description of preferred embodiments accompanied with the illustration of related drawings as follows. It is intended that the embodiments and figures disclosed herein are to be considered illustrative rather than restrictive.

With reference to FIGS. 1 to 4 for an exploded view, a perspective view, a planar view and a cross-sectional view of a modular fan blade of this disclosure respectively, the modular fan blade 1 comprises a first fan blade 10 and a second fan blade 20. The second fan blade 20 is combined with the first fan blade 10 to form the modular fan blade 1 by a combining method.

The first fan blade 10 includes a hub 11 and a plurality of first vanes 12. The hub 11 has an external periphery 111, and the first vanes 12 are combined with the external periphery 111, and a flange 112 is formed at the external periphery 111, and a retaining space 110 is formed at a surface of the flange 112.

The second fan blade 20 includes a fan frame 21 and a plurality of second vanes 22 connected to the external periphery of the fan frame 21. The fan frame 21 is installed to the flange 112 of the hub 11 of the first fan blade 10, sheathed on the hub 11, and installed in the retaining space 110. Therefore, the second vanes 22 of the second fan blade 20 are situated between the outer side of the hub 11 of the first fan blade 10 and the first vanes 12.

In an exemplary embodiment of this disclosure as shown in 1, the hub 11 has a plurality of latch slots 113 formed on the flange 112, and the fan frame 21 has a plurality of hooks 211 corresponsive to the plurality of latch slots 113 respectively, and the second fan blade 20 is latched into the latch slots 113 through the hooks 211 and combined to the hub 11 of the first fan blade 10.

Figure 3:
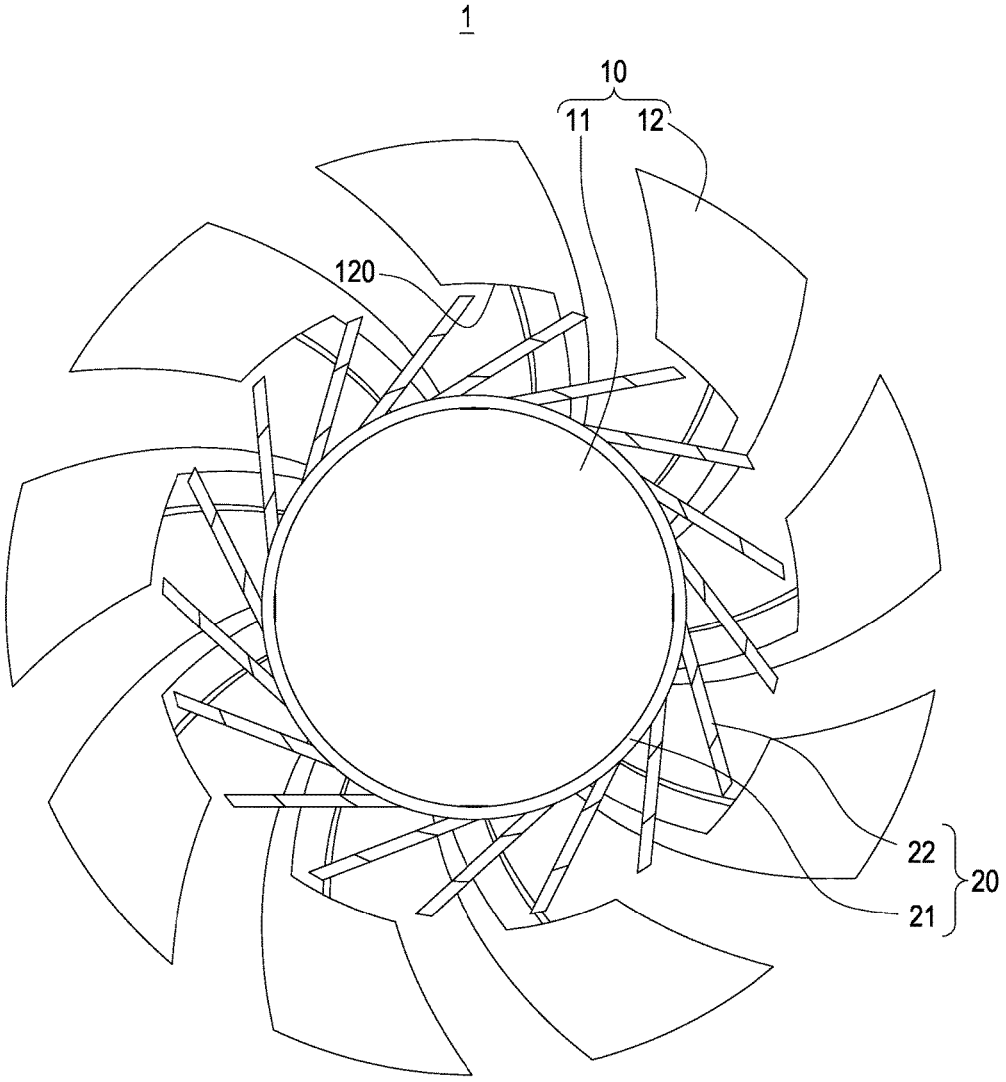
FIG. 3 is a planar view of a modular fan blade of this disclosure.

In this exemplary embodiment as shown in FIG. 3, the first fan blade 10 is an axial flow fan blade, and the second fan blade 20 is a centrifugal fan blade. In actual applications, the first fan blade 10 and the second fan blade 20 are not limited to which fan blade. For example, both the first fan blade 10 and the second fan blade 20 may be axial flow fan blades or centrifugal fan blades, or the first fan blade 10 and the second fan blade 20 are a centrifugal fan blade and an axial flow fan blade respectively.

Preferably, the second vanes 22 are partially disposed on the first vanes 12. Specifically, each of the first vanes 12 has a groove 120 formed on a side proximate to the hub 11, and an end of some of the second vanes 22 is disposed in the groove 120 of the first vanes 12 in order to reduce the total volume of the modular fan blade 1. In an exemplary embodiment of this disclosure, the first vanes 12 and the second vanes 22 are in rotary radiating shape. In addition, the first vanes 12 and the second vanes 22 rotate in opposite directions, but this disclosure is not limited to this arrangement only. For example, the first vanes 12 and the second vanes 22 may be rotated in the same direction as well.

Figure 4:
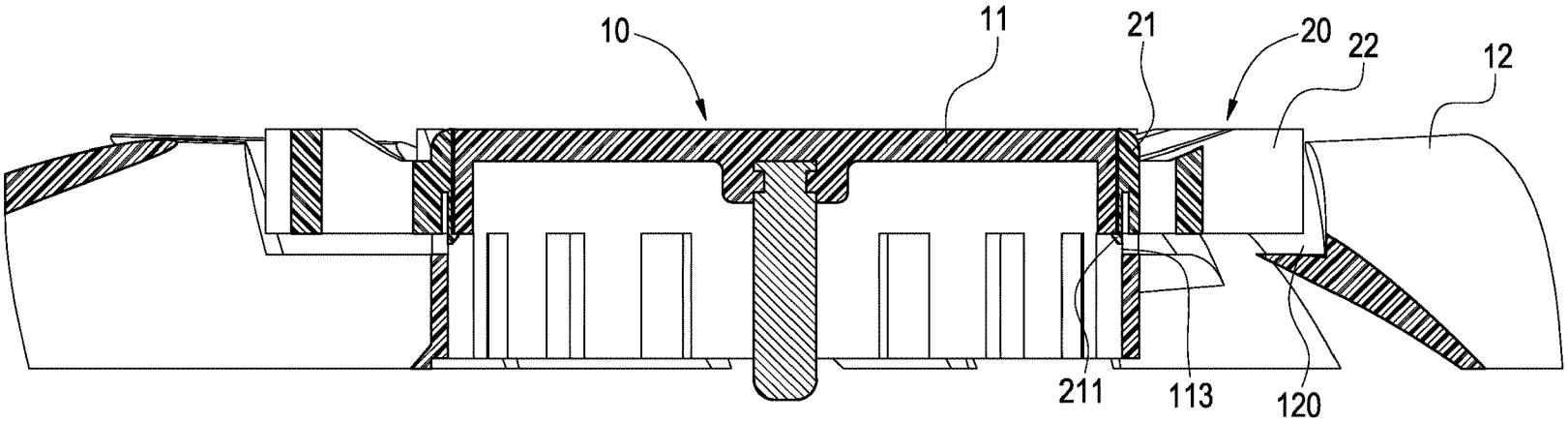
FIG. 4 is a cross-sectional view of a modular fan blade of this disclosure.

In FIG. 4, after the second fan blade 20 is latched to the latch slots 113 through the hooks 211 and combined to the first fan blade 10, the inner peripheral surface of the fan frame 21 is attached to the external peripheral surface of the hub 11. It is noteworthy that the second fan blade 20 is combined with the first fan blade 10 through the hooks 211; however, in practical applications, the second fan blade 20 is combined with the first fan blade 10 by a screwing method. For example, corresponsive threads are formed on the inner wall of the fan frame 21 and the external periphery 111 of the hub 11 and provided for screwing the second fan blade 20 to the first fan blade 10.

Figure 5:
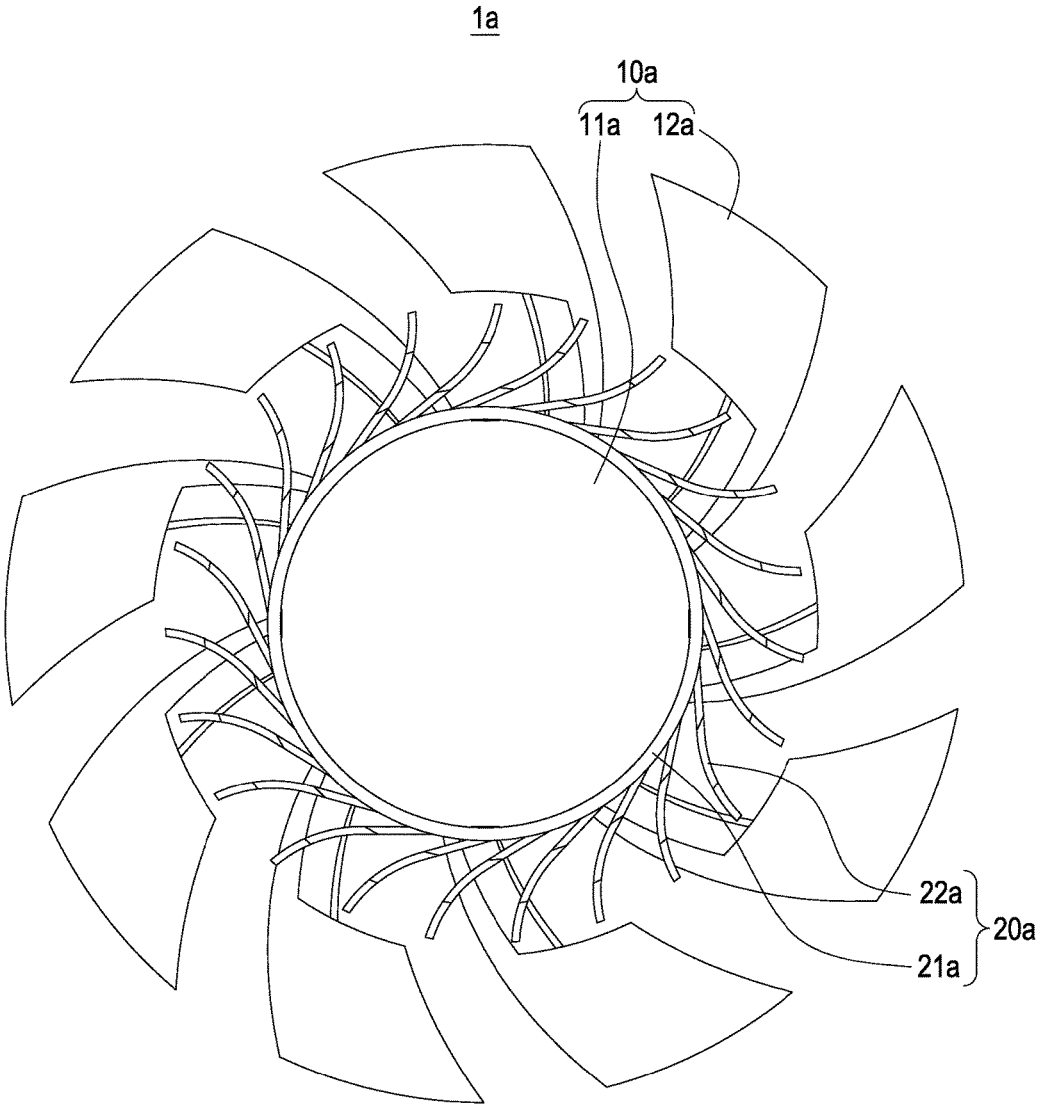
FIG. 5 shows a second exemplary embodiment of a modular fan blade of this disclosure.
Figure 6:
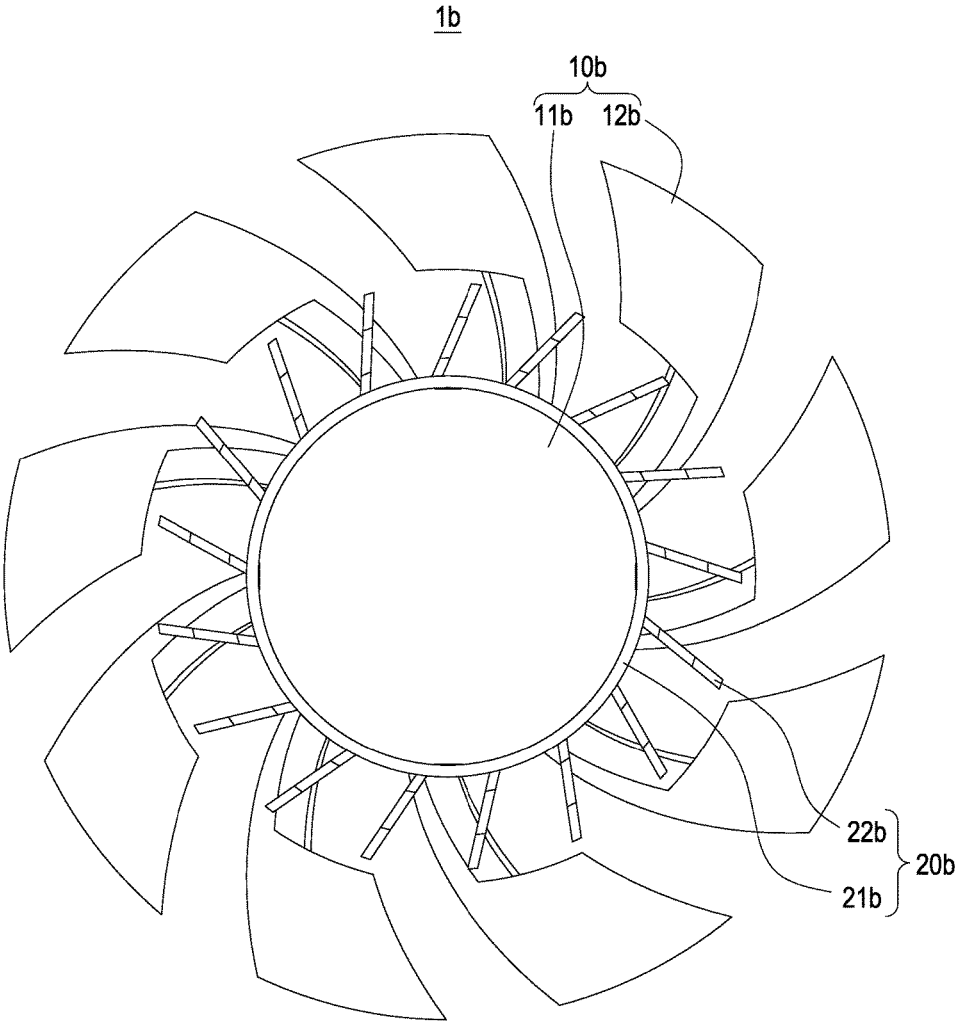
FIG. 6 shows a third exemplary embodiment of a modular fan blade of this disclosure.

With reference to FIGS. 5 and 6 for the second exemplary embodiment and the third exemplary embodiment of a modular fan blade of this disclosure respectively, the modular fan blade 1*a* as shown in FIG. 5 comprises a first fan blade 10*a* and a second fan blade 20*a*. The first fan blade 10*a* includes a hub 11*a* and a plurality of first vanes 12*a*. In addition, the second fan blade 20*a* includes a fan frame 21*a* and a plurality of second vanes 22*a*. The difference between this embodiment and the previous embodiment resides on the configuration of the second vanes 22*a*. In this embodiment, the quantity of second vanes 22*a* is greater, and each of the second vanes 22*a* is a wavy plate.

The modular fan blade 1*b* as shown in FIG. 6 comprises a first fan blade 10*b* and a second fan blade 20*b*. The first fan blade 10*b* includes a hub 11*b* and a plurality of first vanes 12*b*, and the second fan blade 20*b* includes a fan frame 21*b* and a plurality of second vanes 22*b*. The difference between this embodiment and the previous embodiments resides on the configuration of the second vanes 22*b*. In this embodiment, the second vanes 22*b* have a smaller rotating angle, and each of the second vanes 22*a* is an oblique plate, and the second vane 22*a* has a smaller extension length.

In the modular fan blades 1, 1*a*, 1*b* of this disclosure, the second fan blades 20, 20*a*, 20*b* are combined with the first fan blade 10, 10*a*, 10*b*. The combination of the first fan blades 10, 10*a*, 10*b* and the second fan blade 20, 20*a*, 20*b* improves the wind output of the fan. In addition, the first fan blades 10, 10*a*, 10*b* and the second fan blades 20, 20*a*, 20*b* of this disclosure may be used to axial flow fan blades or centrifugal fan blades as needed, so as to improve the flexibility of use.

While this disclosure has been described by means of specific embodiments, numerous modifications and variations could be made thereto by those skilled in the art without departing from the scope and spirit of this disclosure set forth in the claims.

What is claimed is:

1. A modular fan blade, comprising:

a first fan blade, including a hub and a plurality of first vanes, and the hub having an external periphery, and the first vanes being combined to the external periphery, and the external periphery having a flange formed thereon, and a retaining space formed on a surface of the flange; and a second fan blade, including a fan frame, and a plurality of second vanes connected to the external periphery of the fan frame, and the fan frame being disposed at the flange of the hub, engaged with the hub, and installed in the retaining space, wherein each of the first vanes has a groove formed on a side proximate to the hub, and an end of some of the second vanes is disposed in the groove of the first vanes, and a depth of the some of the second vanes inserted in the groove of the first vanes extending in a direction parallel to a central axis of the hub is larger than half a height of the second vanes extending in the direction parallel to the central axis of the hub.

2. The modular fan blade as claimed in claim 1, wherein the hub has a plurality of latch slots formed on the flange, the fan frame having a plurality of hooks corresponsive to the plurality of latch slots respectively, and the second fan blade is latched to the latch slots through the hooks and combined with the hub.

3. The modular fan blade as claimed in claim 1, wherein the second vanes are partially disposed on the first vanes.

4. The modular fan blade as claimed in claim 1, wherein the fan frame has an inner peripheral surface attached onto an external peripheral surface of the hub.

5. The modular fan blade as claimed in claim 1, wherein the first fan blade is an axial flow fan blade, and the second fan blade is a centrifugal fan blade.

6. The modular fan blade as claimed in claim 1, wherein the first vanes and the second vanes are in a rotary radial shape.

7. The modular fan blade as claimed in claim 6, wherein the first vanes and the second vanes rotate in the same direction.

8. The modular fan blade as claimed in claim 1, wherein each of the second vanes is an oblique plate or a wavy plate.

* * * * *